United States Patent [19]

Polson

[11] 4,351,375

[45] Sep. 28, 1982

[54] DUAL SPOUT DISPENSING NOZZLE

[75] Inventor: Charles L. Polson, Cincinnati, Ohio

[73] Assignee: Dover Corporation, Cincinnati, Ohio

[21] Appl. No.: 153,884

[22] Filed: May 27, 1980

[51] Int. Cl.[3] ..... B65B 3/18

[52] U.S. Cl. ..... 141/98; 137/797; 141/302; 141/392

[58] Field of Search ..... 137/68 R, 797; 141/1, 141/59, 98, 198, 206–229, 285, 290, 301, 302, 392

[56] References Cited

U.S. PATENT DOCUMENTS

| | | | |
|---|---|---|---|
| 3,012,592 | 12/1961 | Wright et al. | 137/797 X |
| 3,088,500 | 5/1963 | Payne | 137/797 X |
| 4,199,012 | 4/1980 | Lasater | 141/59 X |
| 4,232,715 | 11/1980 | Pyle | 141/302 X |

*Primary Examiner*—Frederick R. Schmidt

*Attorney, Agent, or Firm*—Kinney & Schenk

[57] ABSTRACT

A fluid dispensing nozzle adapted for dispensing gasoline has dual rigid spouts. The inner spout defines a flow passage for a fluid such as gasoline and the area between the two spouts defines an interspoutal passageway for vapor recovery.

21 Claims, 12 Drawing Figures

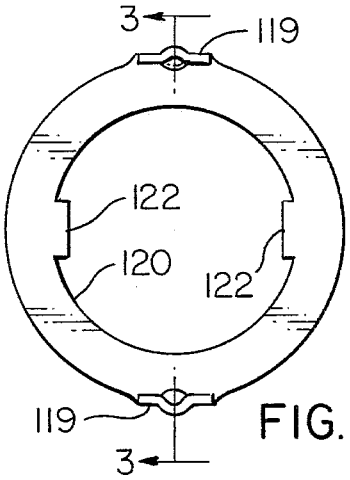
FIG. 2
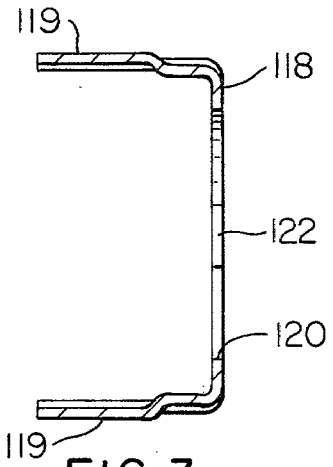
FIG. 3
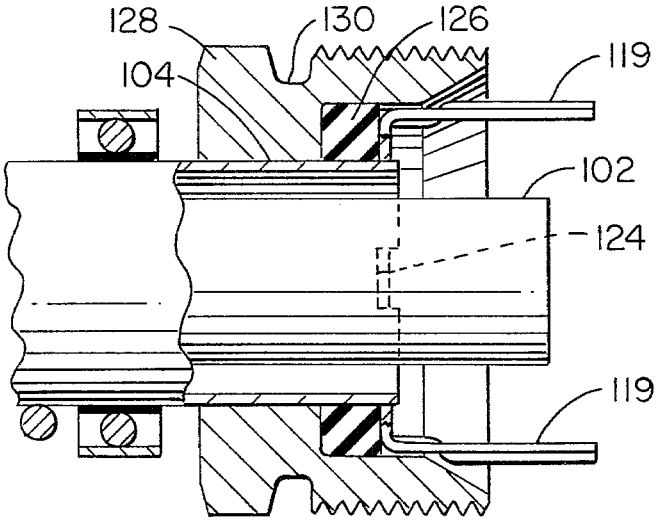
FIG. 6
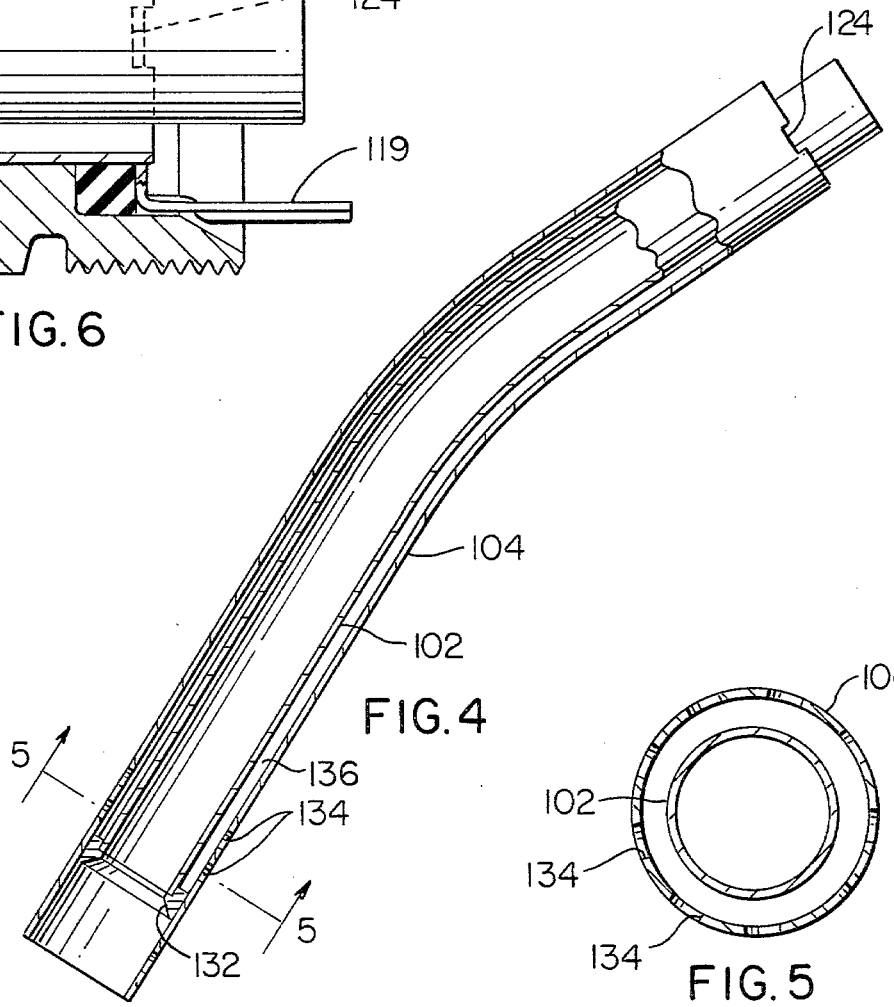
FIG. 4
FIG. 5

FIG. 12
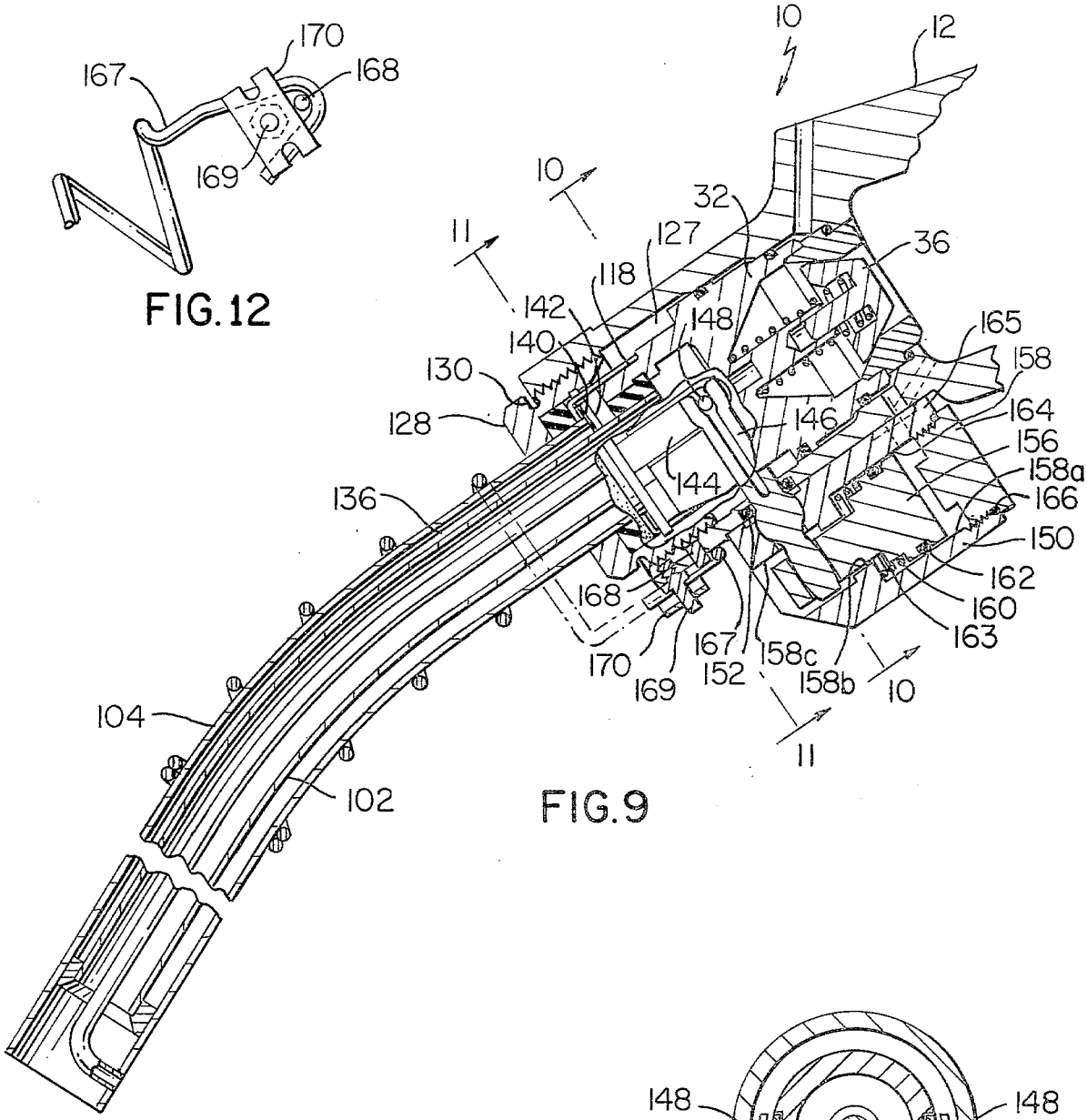
FIG. 9
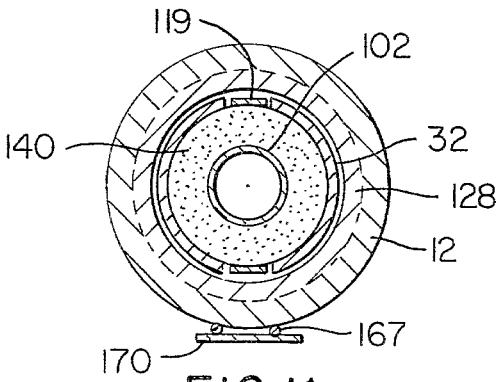
FIG. 11
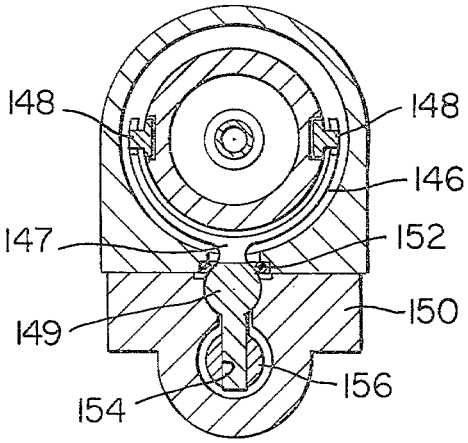
FIG. 10

DUAL SPOUT DISPENSING NOZZLE

BACKGROUND

This invention relates generally to vapor recovery nozzles and more particularly concerns a dual spout vapor recovery nozzle which is easily manufactured. It will be disclosed in connection with a liquid dispensing nozzle adapted for dispensing of gasoline with dual rigid spouts and an interspoutal passageway for the recovery of vapor.

Vapor recovery systems which prevent escape of gasoline vapors into the atmosphere when vehicle gasoline tanks are being filled through a dispensing nozzle are now well known in the art and in wide spread use. Most of these dispensing nozzles have a discharge spout which is enclosed within a flexible bellows. The bellows extends substantially parallel to the discharge spout and cooperates with the spout to form a flow passage between the inner surface of the bellows and the outer surface of the spout. This flow passage is cooperatively connected to a vacuum system to withdraw gasoline vapors which would otherwise escape and pollute the atmosphere.

While these bellows type nozzles have been very efficient, they are not without disadvantages. The bellows are very large, awkward, and bulky. They are also very expensive and susceptible to damage. It has thus been suggested that the bellows type dispensing nozzle be replaced with a double spout nozzle with two concentric rigid spouts. In order to realize this objective, it is necessary to mount both of the rigid spouts upon the nozzle body. Further, the spouts must be mounted in such a way as to maintain manufacturing costs at a level which makes the double spout nozzle price competitive with the bellows type nozzles. Thus, the mounting of both of the spouts to the body of a nozzle must be done in a manner that permits all of the component parts to be readily machined.

Moreover, it is highly desirable to provide a dispensing nozzle with a preferred spot of weakening. That is, a preferred spot or location at which the nozzle will break in the event that it is subjected to extreme stress, such as when a vehicle pulls away from a gasoline pump before the dispensing nozzle is removed from the vehicle tank or when the nozzle is dropped to the ground. The most preferred location for breaking the nozzle is at the spout, downstream of the valving members in the dispensing nozzle. If the nozzle is not designed to break at a preferred location in such a situation, movement of the vehicle may pull the gasoline pump off it's foundation, dislodge the fuel tank from the vehicle, or sever the hose connecting the pump and the nozzle. Each of these consequences is highly undesirable.

The device to provide a preferred spot of weakening has been accentuated drastically in recent years with the proliferation of self-service gasoline stations in which consumers dispense gasoline into their own vehicles. The wide spread practice of permitting inexperienced personnel to operate gasoline pumps further increases the likelihood that a vehicle will be moved before the dispensing nozzle is removed from the fuel tank.

In the absence of some procedure to insure that a vehicle does not pull away from the gasoline tank and that the nozzle is not broken by some other action such as dropping the nozzle to the ground or otherwise impacting the nozzle, it is also important to design the nozzle such that any breakage will result in the minimum of inconvenience. Preferably, the nozzle is designed with a spot of weakening which will facilitate breakage in such a manner that the nozzle may be quickly repaired in the field at a minimum expense.

Accordingly, it is the primary aim of the present invention to provide a dispensing nozzle which overcomes each of the aforementioned shortcomings without offsetting disadvantages.

It is therefore an object of the present invention to provide an easily manufacturable vapor recovery nozzle with dual concentric rigid spouts.

It is a further object of the present invention to provide a vapor recovery dispensing nozzle which eliminates the need and expense of a flexible bellows.

It is a further object of the present invention to provide a dual spout dispensing nozzle with means for selectively blocking the interspoutal passageway between the spouts.

It is a further object of the present invention to provide a vapor recovery nozzle with dual concentric rigid spouts in which the nozzle has a preferred spot of weakening which facilitates breakage at a preferred location whenever the nozzle experiences impact.

It is a further object of the present invention to provide a vapor receovery nozzle which is easily, readily, and inexpensively repaired in the field after breakage.

It is yet another object of the present invention to provide a rigid dual spout vapor recovery nozzle which securely locates and retains each of the spouts.

SUMMARY OF THE INVENTION

In accordance to the invention, a dispensing nozzle has a nozzle body with an inlet and an outlet and a flow passage therebetween. An adapter is securely fitted in the nozzle body outlet. An inner spout of a pair of rigid concentric spouts is sealingly received by the adapter for selective fluid communication with the nozzle body inlet. A locating element is attached to both the spout adapter and the outer spout and is operative to prevent relative rotational movement between these two elements. The outer spout is secured to the nozzle body by retaining means which is releasably received to the body.

In the preferred form, the nozzle has an interspoutal passageway between the dual rigid spouts, with the spouts being rigidly and sealingly connected to a location distal to the nozzle body. The interspoutal passageway is used with a vacuum system to withdraw vapors through perforations in the outer spout into the interspoutal passageway.

In accordance to a further aspect of the invention, the retaining means has a location of weakening, a shear groove in the preferred embodiment, which provides a preferred location for any breakage in the nozzle. Breakage at this preferred location prevents damage to other elements of the nozzle and facilitates quick, convenient and inexpensive repair.

In accordance to yet another aspect of the invention, the interspoutal passage between the dual spouts is selectively opened in response to fluid flow in the nozzle.

BRIEF DESCRIPTION OF THE DRAWINGS

Other objects and advantages of the invention will become apparent upon reading the following detailed description upon reference to the drawings, in which:

FIG. 2 is an end view of the locator element used in the dispensing nozzle of FIG. 1 illustrating tabs which are received in the outer nozzle spout in FIG. 1.

FIG. 3 is a cross section of the locating element of FIG. 2 taken along line 3—3.

FIG. 4 is a fragmentary elevational view, partially in cross section, of the dual spouts used in FIG. 1 showing slots for receiving the locating element shown in FIGS. 1 and 2.

FIG. 5 is a cross sectional view of the spouts of FIG. 4 taken along line 5—5.

FIG. 6 is a fragmentary elevational view, partially in cross section, of the dual spouts of FIG. 1 illustrating their relationship with the locating element, vapor seal and spout.

FIG. 9 is a fragmentary elevational view of an alternate embodiment of a dispensing nozzle which includes sealing means for selectively blocking the interspoutal vapor passage.

FIG. 10 has a cross sectional view of the dispensing nozzle of FIG. 9 taken along line 10—10.

FIG. 11 is a cross sectional view of the dispensing nozzle of FIG. 9 taken along line 11—11.

FIG. 12 is a bottom view of the anchoring spring of FIG. 9 with the push nut which secures the anchoring spring to the nozzle body.

While the invention will be disclosed in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENTS

Figure 1:
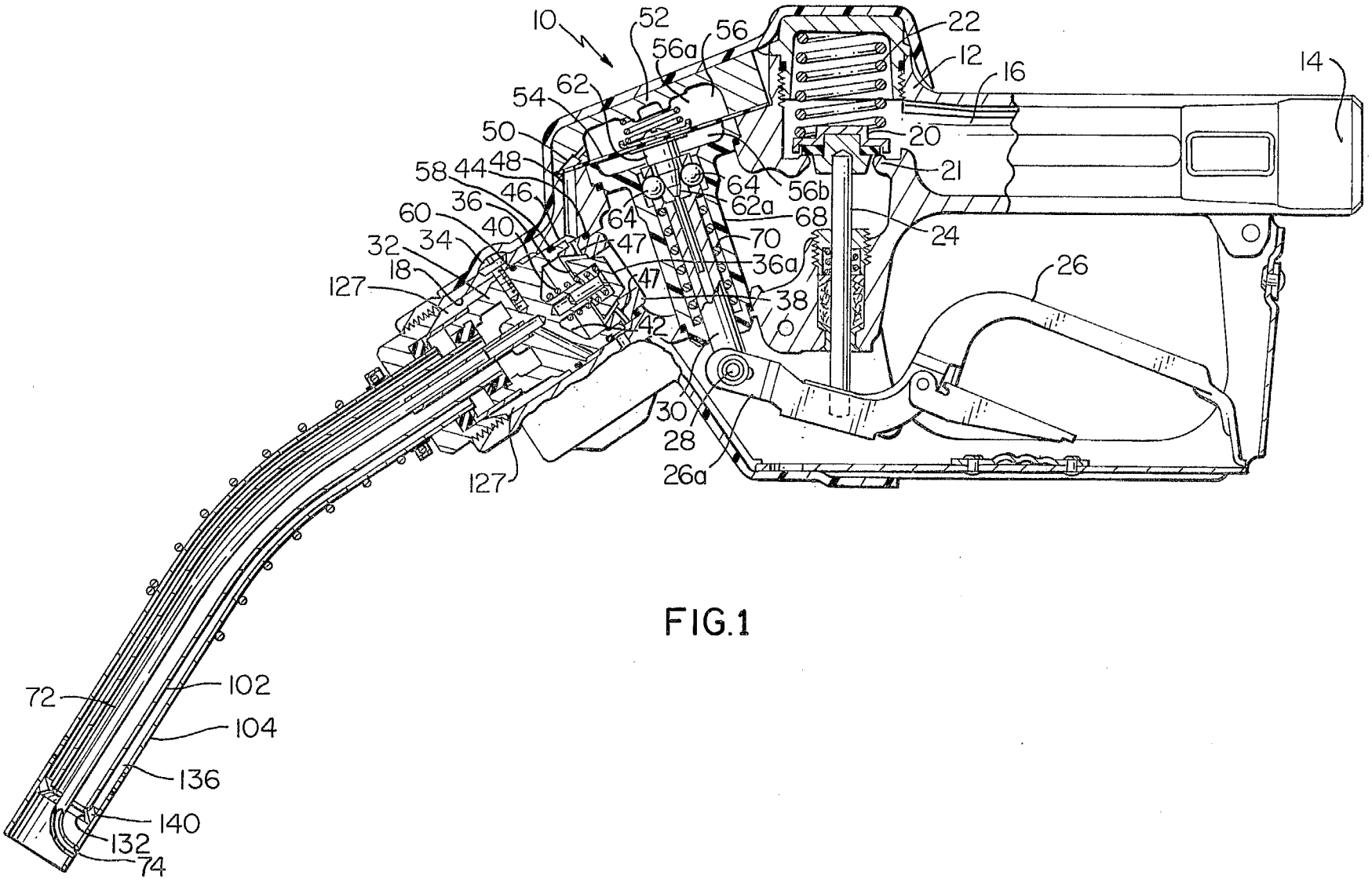
FIG. 1 is an elevational view, partially in cross section, of a dual spout dispensing nozzle for dispensing gasoline from a gasoline pump to a vehicle tank.

Referring now to the drawings and to FIG. 1 in particular, a vapor recovery nozzle generally designated by the numeral 10 is shown. The nozzle 10 has a body portion 12 which contains an inlet opening 14 which is in fluid communication with a pressurized liquid supply, such as gasoline, through a hose (not shown). An internal flow passage 16 in the body 12 connects the inlet opening 14 to an outlet opening 18. The flow passage 16 has a main poppet valve 20 intermediate of the inlet and outlet openings 14 and 18 to selectively control fluid flow therebetween.

A compression spring 22 is disposed between the top (as illustrated) portion of the nozzle body 12 and the top of the main poppet valve 20 to urge that poppet valve 20 downwardly into a seated position against a seat 21. The poppet valve 20 is effective to eliminate fluid flow through the passage 16 whenever it is in the seated position illustrated in FIG. 1.

An actuating stem 24 is connected to the lower side of the poppet valve 20, opposite the spring 22. The actuating stem 24 extends through a body to a location exterior of the body 12. The manner in which stem 24 passes through the body 12 is known in the art and described in U.S. Pat. No. 3,811,486 to Wood. Since this manner of passing the actuating stem through the body is known as part of the prior art and forms no part of the present invention, no further description thereof will be made.

A manually operated lever 26 engages the lower end of the actuating stem 24. This lever 26 has a yoke 26*a* on one of its extremities which is pivotally connected to a pin 28 which is in turn secured to a plunger 30.

A spout adapter 32 is securely disposed within the outlet 18 of the body 12 through the agency of a screw 34, the screw 34 being preferably formed of metal. The spout adapter 32 contains a second poppet valve 36 which is spring biased against a seat 38 by a spring 40 which engages the spout adapter. The seat 38 is threadably received by the spout adapter 32 after disposition of the second poppet valve 36 and spring 40 into a valve receptive cavity 42 in the adapter 32 during assembly.

A sealing ring 44 is circumferentially fitted about seat 38 to prevent fluid flow between the interior of the nozzle body 12 and a first annular chamber 46 formed between the nozzle body 12 and the spout adapter 32.

The second poppet valve 36 is normally urged to a closed position by its associated spring 40. However, the spring rate of spring 40 is selected such that whenever pressurized fluid is permitted into the central interior portion of the nozzle body 12, this pressurized fluid will act upon the interior face 36*a* of the second poppet valve 36 and the resultant force will be sufficient to overcome the bias of spring 40 unseating the valve 36. The unseating of poppet valve 36 establishes an internal flow passage between the central portion of the body 12 through an outlet 18.

A plurality of radially extending channels 47 extend through the seat 38 from the interior flow passage through the seat 38, proximal to the second poppet valve 36, to the first annular chamber 46. A fluid passage 48 in the body 12 communicates between the annular chamber 46 and an obliquely oriented passageway 50 in a cap section 52 of the nozzle through a hole in a diaphragm 54. The cap 52 together with the nozzle body 12 cooperatively form a chamber 56 which is divided into two separate sub-chambers 56*a* and 56*b* by the diaphragm 54, the obliquely oriented passageway 50 communicating with the uppermost sub-chamber 56*a*.

Sealing rings 58 and 60 circumscribe the spout adapter 32. They serve to prevent air from entering the chamber 46 from the exterior of the body 12 and define a second chamber 61 between the spout adapter 32 and body 12 intermediate the exterior of the body 12 and the first chamber 46.

The diaphragm 54 has a latch retaining pin 62 which is secured to the diaphragm's central portion for common movement therewith. The latch retaining pin 62 is disposed between three balls 64 (two of which are illustrated) which are positioned within passages in the latch plunger 30. When the latch retaining pin 62 is in the position shown in FIG. 1, the balls 64 prevent downward movement of the plunger 30. The plunger 30 is slidably mounted within a plunger track 68 supported in the body 12.

When the diaphragm 54 is urged upwardly due to a reduction in air pressure or an increase in the partial vacuum in sub-chamber 56*a*, the latch retaining pin 62 is moved upwardly therewith. This upward movement of the retaining pin 62 positions a tapered portion 62*a* of the retaining pin 62 between the balls 64. The balls 64 are then permitted to move inwardly allowing the plunger to be moved downwardly under the impetus of a spring 70. The correlation between the tapered portion of the pin 62*a* and the latch plunger track 68 is known in the art and shown more specifically in U.S. Pat. No. 2,582,195 to Duerr.

As described above, the lower end of plunger 30 is pivotally connected to the yoke 26*a* on the extremity of lever 26. The details of this connection are also known in the art and are more particularly shown and described in U.S. Pat. No. 3,817,285 to Wilder et al. Thus, when the diaphragm 54 moves upwardly due to an increase in the partial vacuum of sub-chamber 56*a*, the latch retaining pin 62 is also pulled upwardly, releasing latch plunger 30 from the balls 64. Since the pin 28 is fixed in the plunger 30, the downward movement of the plunger 30 under the bias of spring 70 causes the pin 28, about which lever 26 is pivotally attached, to be lowered correspondingly. As more fully shown and described in the aforementioned Wilder et al patent, this downward movement of the pivotal pins 28 closes the main poppet valve 20.

As those skilled in the art will readily appeciate, the partial vacuum in sub-chamber 56*a* is controlled as a function of the liquid level in the tank into which fluid from the nozzle 10 is being discharged. A vacuum tube 72 communicates with an end opening 74 as shown on the left hand side of FIG. 1. As long as the poppet valves 20 and 36 are open and the opening 74 for vacuum tube 72 is not closed due to liquid in the tank reaching a predetermined level that indicates the tank is filled, the venturi effect created by the flow of liquid past the seat ring 38 in the poppet valve 36 draws air through the tube 72 to create a partial vacuum within the sub-chamber 56*a*. However, as soon as the vacuum tube opening 74 is blocked, the chamber 56*a* has its pressure reduced due to air in the sub-chamber being drawn therefrom because of the venturi effect in the passage 47. The diaphragm 54 then moves upwardly since the partial vacuum in the chamber 56*a* is increased. This venturi effect is more particularly described in U.S. Pat. No. 3,085,600 to Briede.

The novelty in the illustrated embodiment of FIG. 1 lies in the mounting of the dual rigid spouts. As shown in FIGS. 1, 4, 7, and 8 the nozzle 10 has two rigid discharge spouts 102 and 104 extending from the discharge outlet 18. Inner spout 102 is concentric with and disposed within the outer spout 104.

Figure 7:
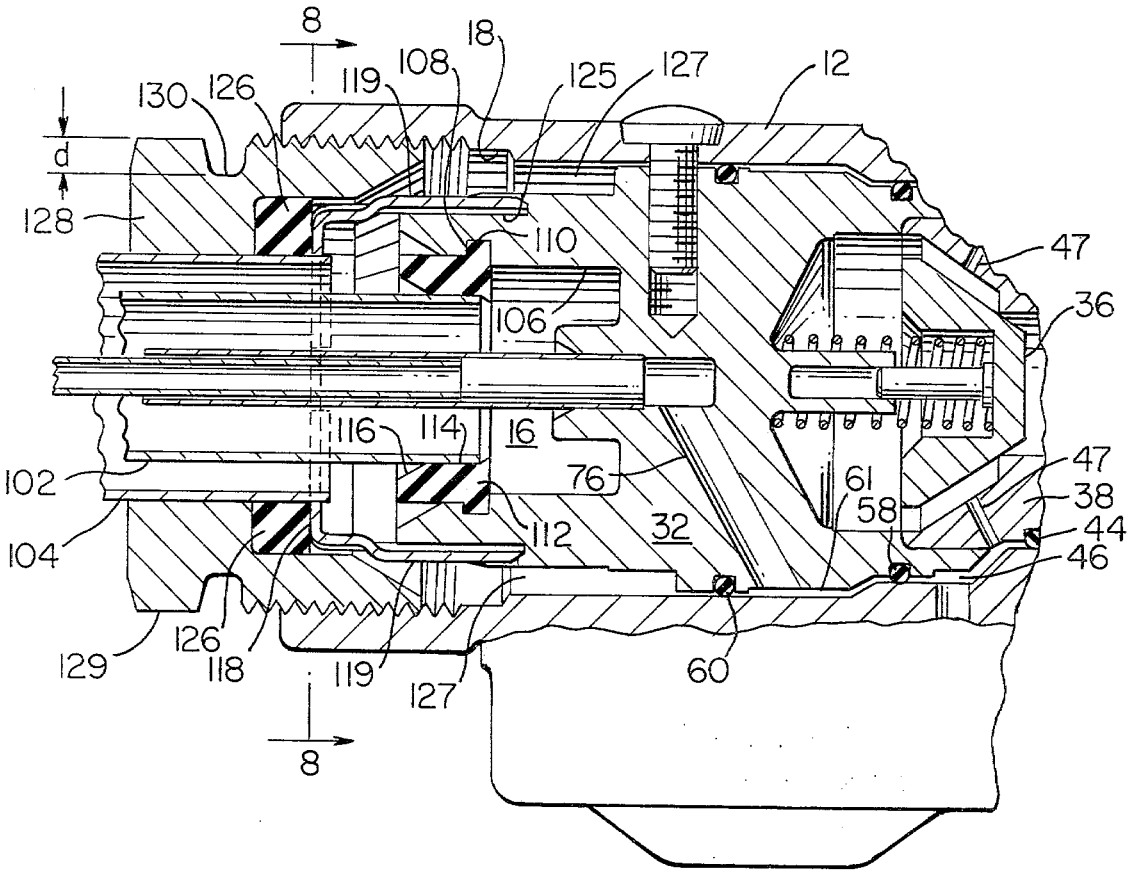
FIG. 7 is a fragmentary elevational view, partially in cross section, of the spout adapter used in FIG. 1 showing the relationship between the dual spouts, the spout adapter, the locating element, the retaining nut and the nozzle body in greater detail.
Figure 8:
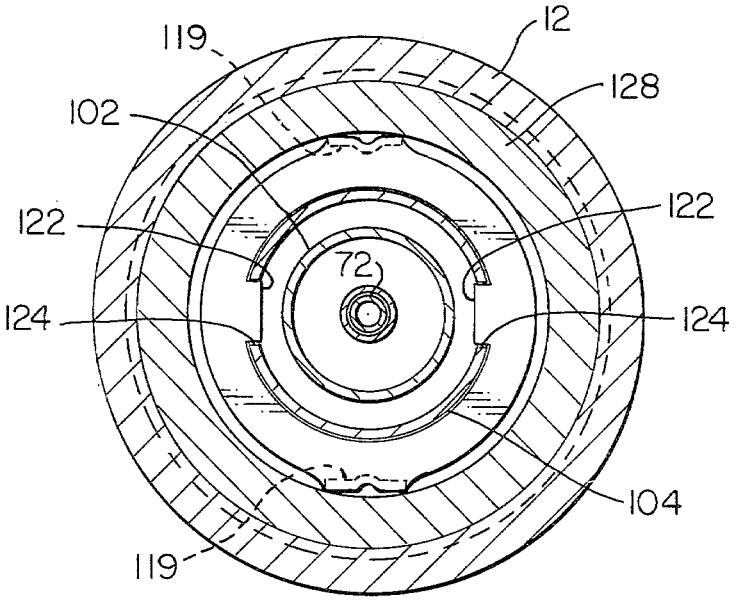
FIG. 8 is a cross-sectional view of the spout adapter and related elements of FIG. 7 taken along line 8—8.

Referring now to FIG. 7, the adapter 32 contains an open ended internal bore 106 with an annular groove 108 on its internal periphery. The annular groove 108 receives an annular projection 110 of an inner seal 112 which is sized to compressingly fit therein. The compression fit is achieved by sizing the diameter of the inner seal to be slightly in excess of the groove 108 and forcing the inner seal into the groove. Thus, the annular projection 110 on inner seal 112 functions in a manner analogous to a custom designed O-ring.

The inner seal 112 has an inner circumferential sealing surface 114 which extends parallel to the circumferential surface of the bore. The inner spout 102 is sealingly received by the inner seal 112 and the two elements interface along the sealing surface 114 of the seal 112. The distance of the interface between the inner seal 112 and the inner spout 102 is not critical so long as the distance is sufficiently long to establish a sealing relationship therebetween. The inner seal isolates the fluid flow passage 16 which extends through the interior of inner spout 102 with a vapor chamber 127 located in the spout adapter 32 and the body 12.

The interface surface 114 is joined by an adjacent tapered surface 116 which diverges away from the inner spout 102. This taper or slope 116 provides a lead-in for the inner spout 102 when the inner spout 102 is inserted during assembly. The slope or lead-in 116 also insures self centering of the inner spout 102. The inner seal 112 and its relationship with the inner spout 102 is also shown in FIG. 1 in lesser detail.

A locator element 118 is securely fitted on the outer spout 104 and has a pair of axial extensions 119 projecting inwardly toward the spout adapter for engagement therewith. As shown in FIGS. 2 and 3, the locator element has an internal circumferential surface 120 with two tabs 122 extending radially inward therefrom. The internal surface 120 is fitted about an outer circumferential surface of the outer spout 104 with the tabs 122 being received by a pair of mating notches 124 in the outer tube 104 (see FIGS. 4 and 6). The axially projecting extensions 119 of the locator element 118 are, in turn, received by slots 125 (see FIG. 7) in the spout adapter where the side and end surfaces of the slots 125 engage mating end and side surfaces of the extensions 119 to prevent relative rotational movement between the locating element 118 and the spout adapter. This prevents further axially inward movement as well as rotational movement of the locator element relative to the spout adapter. It is thus seen that the locator 118 serves to locate the outer spout 104 and to maintain that position relative to the spout adapter. As mentioned above, the spout adapter is in turn fixedly secured to the nozzle body 12 through the agency of a screw 34. Thus, the outer spout 104 is fixed relative to the nozzle body 12.

A vapor seal 126 (FIGS. 6 and 7) surrounds the outer spout 104 adjacent the locator inserter to seal the vapor path between the outer surface of the outer spout 104 and a retainer or spout nut 128 for preventing atmospheric escapage of vapor. The retainer or spout nut 128 is threadably received within outlet opening 18 and axially advanced toward the vapor seal 126 as the nut 128 is screwed into the outlet opening 18 to compressingly engage the vapor seal 126 axially and circumscribe it radially. The spout nut 128 has a hexagonal head 129 to accommodate a wrench for rotating and axially advancing the spout nut into the outlet opening 18. As will be appreciated by those skilled in the art, the vapor seal 126 serves to hold the outer spout 104 in place while the spout nut is being screwed into place during assembly.

The spout nut 128 has a preferred spot of weakening in the form of a break-away groove 130 as shown in FIGS. 1 and 7. The break-away groove 130 completely surrounds the spout nut 128 and has a predetermined depth, d, so that the nut 128 is calculated to break at this location at a predetermined force.

When the spouts are inserted into the fuel tank of a vehicle, movement of the vehicle away from the gasoline pump will force the nozzle to pivot at a location on the nozzle body. The break-away groove is designed with a shearing strength which is less than adjacent structure and provides a preferred shearing location for the nozzle in such circumstances.

It is thus seen that the retainer or spout nut is multipurpose. First, it holds the outer spout 104 to the nozzle body. As the spout nut 128 is rotated and axially advanced to the vapor seal 126, the nut 128 compresses the vapor seal 126 and forms a friction seal between itself and the outer spout 104. Second, it also forms a preferred shearing location at the break-away groove 130.

The use of a break-away groove 130 also has multiple advantages. It forces the nozzle 10 to break at that location 130 and thus protects the nozzle body 12 from damage. When the spout nut 128 breaks, the nut 128 no longer functions to hold the outer spout 104. The inner spout 120 is then permitted to separate from the inner seal 112. Thus, the only element which is broken and need be replaced is the spout nut 128 itself. Both of the spouts 102 and 104 separate from the nozzle body 12 without damage. The spout nut 128 is relatively inexpensive and the nozzle 10 may be readily and quickly replaced in the field without the necessity of sending the nozzle 10 back to the factory.

Referring now to FIGS. 1 and 4, it is seen that the discharge end of the spouts 102 and 104, distal to the nozzle body 12, contains a seal 140 between the inner spout 102 and the outer spout 104. The seal 140 is preferably formed of stainless steel and is silver soldered to the outer tube 104 and the inner tube 102. In the preferred embodiment, stainless steel is used because of the strength required in the square inch area between the inner and outer tubes 102 and 104. Inasmuch as the spouts of the preferred embodiment are designed to be inserted into the fuel tank of a vehicle, the dimension of the outer spout has a maximum permissible dimension in order to permit such an insertion.

The inner spout 102 provides a flow passage for fluid to be discharged from the nozzle 10 and obviously has minimum dimensional requirements which are dictated by the fluid flow rate desired of nozzle 10. Further, as will be seen, the inner spout 102 has a limitation as to its maximum dimension because a vapor flow passage is to be formed between the inner and outer spouts. This seal 140 diverges as it extends toward the discharge end of the spouts and has an obliquely oriented surface 132 which serves to spread out or disperse flow discharged from the inner spout 102. The spouts 102 and 104 are not coterminous. The seal 140 located at the end of the inner spout 102 but axially inwardly of the terminus of outer spout 104. Conversely, as illustrated best in FIGS. 4 and 6, on the end proximal to the body 12, the inner spout 102 extends axially beyond the outer spout 104.

As seen in both FIGS. 4 and 5, the discharge end of the outer spout 104 has two rows of perforations 134 axially inward of the seal 140 to provide vapor communication between the outside of the outer spout 104 and the interspoutal passageway 136 formed between the inner and outer spouts. As those skilled in the art will appreciate, the perforations 134 are designed to permit entry of gasoline vapors when the spouts are emerged in a vehicle fuel tank. The vapors are drawn through the perforations 134 and through the interspoutal passageway formed between the spouts 102 and 104 to the vapor chamber 127 through the agency of a vacuum system in a manner which is analogous to prior art vapor recovery systems which withdraw vapors between the rigid spout and the flexible bellows.

The vacuum system then further withdraws the vapors from the vapor chamber 127 through a passageway (not shown) in the body 12 into a vapor recovery hose communicating to a vapor recovery pump.

In operation, both of the spouts 102 and 104 are manually inserted in a fill tank. Lever 26 is then manually pulled upwardly toward the body 12 to overcome the bias of spring 22 and open poppet valve 20 to selectively establish flow through the nozzle 10. Pressurized liquid, gasoline in the preferred embodiment, is the permitted to enter the central internal portion of the body 12. The pressurized liquid is applied against poppet valve 36 which is then opened against the bias of spring 40.

The opening of poppet valve 36 establishes the fluid communication between the central internal portion of the body 12 and the interior of inner spout 102. Liquid thus flows through the inner spout 102 to its terminus proximal seal 140 when the liquid passes to the outer spout 104 from which it is discharged into the fill tank.

While discharging liquid into the fill tank, the vapor recovery pump includes vapor, gasoline vapor in the preferred embodiment, through perforations 134 proximal to the discharge end of outer spout 104. This vapor is drawn in the interspoutal flow passage between inner spout 102 and outer spout 104 to vapor chamber 127. The vapor then flows through a vapor return passage (not shown) communicating with vapor chamber 127 as is well known in the art. The vapor return passage in turn communicates with a vapor recovery hose which communicates with vapor recovery equipment in a conventional fashion.

As long as the lever 26 is urged against the force of spring 22, liquid flow will continue through the body 12 and through the discharge spouts until the fill tank is filled to a predetermined level at which inlet 74 to vacuum tube 72 is blocked. When this occurs, the partial vacuum in sub-chamber **56*a* is increased due to the absence of air from the inlet 74 to the passages 47 in the ring seat 38. The diaphragm 54 thus moves upwardly to cause automatic closing of the main poppet valve 20**.

FIGS. 9–12 depicts an alternate embodiment of the dual spout dispensing nozzle with a sealing means for selectively blocking vapor communication between the interspoutal passageway and the vapor return passage. Since many of the components of this second embodiment are identical or similar to corresponding components of the first described embodiment, like numbers will be used for similar parts.

The depicted embodiment of FIG. 9, like the embodiment of FIGS. 1 and 4, includes a nozzle body portion 12 which supports a pair of concentric spouts 102 and 104 from the discharge end of the nozzle, inner spout 102 being disposed within outer spout 104. As in the first described embodiment, the interspout 102 is sealingly received by a sealing member 112 fitted with an adapter element 32. Further, a locator element 118 is fitted on the outer spout 104 with axial extensions engaging the adapter 32.

This embodiment of FIGS. 9–12 differs friom that of FIGS. 1 and 4 in that it also includes a sealing member 140 which blocks vapor communication between the interspoutal passageway 136 and vapor chamber 127. The sealing member 140 (which completely circumscribes the interspout 102) is supported by a metal backup plate 142 which has a pair of axially extending ears 144 (only one of which is illustrated in FIG. 9, the other ear is shown in FIG. 10). The metal backup plate 142 (including the sealing member 140) and its ear portions 144 are slidably fitted within the body 12 of the nozzle 10 for reciprocal movement in the axial direction. This axial movement is effectuated by a pair of split arms 146 (only one of which is shown in FIG. 9) of a yoke 147. Each of these split linkage arms cooperatively interact with pins 148 which extends radially outward from the ears 144 on opposite sides thereof. The linkage arms 146 are split on their end portions in the vicinity of pins 148 to permit overtravel movement of the metal backup plate and the radially extending pins 148 in particular. The split in the linkage arms 146 act as springs and serve to reduce stress and possible breakage of the ears 146.

The yoke 147 has an intermediate bulbous portion 149 which pivotally rests in a similarly shaped opening in a hydraulic cylinder body 150 which is rigidly affixed to the nozzle body 12. An O-ring 152 sealingly engages the yoke adjacent to this bulbous portion 149 to provide a fluid seal on the side of the bulbous portion 149 which is most proximal to the pins 148. The opposite end of yoke 147 (distal to the radially extending pins 148) extends through an opening 154 of the hydraulic piston 156, the hydraulic piston being reciprocally movable within the hydraulic cylinder body 150.

The hydraulic cylinder 150 contains an internal bore 158 with a first enlarged portion 158*a*, a central portion 158*b* of reduced diametral dimension and a third or yoke engagement portion 158*c* of intermediate diametral dimension. A resilient biasing return means shown as a compression spring 160 rests upon a shoulder 163 at the interface of bore portions 158*a* and 158*b* to urge the hydraulic piston rightwardly in the illustration. An O-ring 162 is circumferentially disposed about the periphery of the piston 156 to establish a sealing relationship between the piston 156 and the bore portion 158*a*.

The right end (as depicted) of bore portion 158*a* is in open fluid communication with the internal flow passage 16 at a location intermediate of the manually operated poppet valve 20 and the second poppet valve 36 within the nozzle body 12 through an internal passageway 165. A cap 164 with a seal 166 is threadably received in the end of the bore portion 158*a* opposite the central bore portion 158*b*.

FIG. 12 illustrates a bottom view of a means for securely but releasably retaining an anchoring spring 167 about the peripheral surface of outer spout 104. Since the present invention includes a preferred breaking location for the nozzle, it is desirable to securely retain the anchoring spring 167 to the outer spout under normal operating conditions, but to free the anchoring spring 167 from the nozzle body 12 in the event that a vehicle is moved while the dispensing nozzle 10 is inserted into the vehicle's fill tank. A pair of pins 169 and 168 are threadably engaged into the nozzle body 12. Anchoring spring 167 is configured to wrap around pin 168 while disposing segments of the spring proximal to pin 169. A push nut 170 fitted about pin 169 engages the anchoring spring 167 on opposite sides of the pin 168.

When the spout nut breaks at groove 130, the spout generally moves downwardly (as illustrated). This downward movement will apply a moment force to push nut 170, forcing the push nut 170 off pin 169 and freeing the spring for movement with the spout. Thus, if a vehicle moves away from a gasoline fill pump with the dispensing nozzle inserted into the vehicle's fill tank, the spout nut 128 will break at breakaway groove 130 and the anchoring spring 167 will be carried away with the dual spouts. FIG. 11 depicts the anchoring spring 167 held against the dispensing nozzle body 12 by push nut 170.

As should be apparent to those skilled in the art from the above description, the sealing member 140 selectively blocks the interspoutal vapor passage 136 in response to liquid flow through the internal flow passage 16. Since flow through this internal flow passage 16 is controlled by the position of the manually operated poppet valve 20, the sealing means is likewise responsive to the position or movement of this poppet valve 20 and the lever 26. the hydraulic piston 156 and yoke 147 cooperatively interact to open or move the sealing means 140 in a first predetermined direction in response to fluid flow in the opposite direction. The return spring applies a bias to the piston 156 to return the piston to a first predetermined position (corresponding to the normally closed position of the sealing means) whenever fluid pressure applied to piston 156 is terminated by closing the poppet valve 20.

Thus it is apparent that there has been provided, in accordance with the invention, a dual spout vapor recovery nozzle that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A dispensing nozzle, comprising:

(a) a nozzle body having an inlet and an outlet with a flow passage therebetween;

(b) an adapter securely fitted in the outlet of the nozzle body;

(c) a pair of rigid concentric spouts extending from the nozzle body outlet including an inner spout disposed with an outer spout, an end portion of the inner spout being sealingly received by the adapter for selective fluid communication with the nozzle body inlet;

(d) a locating element attached to both the adapter and the outer spout, the locating element being operative to prevent relative rotational movement between the outer spout and the adapter; and (e) retaining means releasably secured to the nozzle body for securing the outer spout relative to the nozzle body.

2. A dispensing nozzle as recited in claim 1 including a vapor seal circumferentially fitted on the outer periphery of the outer spout, the retaining means being axially movable about the periphery of the outer spout to sealingly engage the vapor seal.

3. A dispensing nozzle as recited in claim 1 wherein the locating element includes a plurality of axially extending arms which maintains an axial separation between the spout adapter and the outer spout.

4. A dispensing nozzle as recited in claim 1 wherein the inner and outer spouts define an interspoutal passageway between the inner surface of the outer spout and the outer surface of the inner spout and wherein the inner and outer spouts are sealingly connected at a location distal to the nozzle body, the outer spout having a plurality of perforations intermediate the sealing connection providing vapor communication between the exterior of the outer spout and the interspoutal passageway.

5. A dispensing nozzle as recited in claim 4 wherein the outer spout extends beyond the terminus of the inner spout distal to the nozzle body.

6. A dispensing nozzle as recited in claim 5 wherein the locating element is circumferentially fitted about the outer spout with radially inwardly extending tabs, the outer spout having notches receiving the tabs.

7. A dispensing nozzle as recited in claim 1 wherein the retaining means is threadably and internally received by the nozzle body outlet for axial movement along the periphery of the outer spout.

8. A dispensing nozzle as recited in claim 1 wherein the retaining means has a location of weakening at which any breakage is preferred.

9. A dispensing nozzle as recited in claim 8 wherein the location of weakening is a shear groove about the periphery of the retaining means.

10. A vapor recovery dispensing nozzle for use in dispensing gasoline comprising:

(a) a nozzle body having an inlet and an outlet and a liquid flow passage therebetween;

(b) a manually operated valve in the liquid flow passage intermediate of the inlet and outlet for controlling liquid flow through the nozzle;

(c) a spout adapter securely fitted within and extending from the body outlet;

(d) an inner spout sealingly received by the spout adapter in selective fluid communication with the liquid passageway;

(e) an outer spout radially spaced from the inner spout to define an interspoutal passageway therebetween, the inner and outer spouts being rigidly and sealingly connected at a location distal to the body, the outer spout having perforations which permit vapor communication between the exterior of the spout and the interspoutal passageway;

(f) a locating element engaging both the outer spout and spout adapter, the locating element having means for preventing relative rotational movement between the outer spout and the spout adapter;

(g) a vapor seal fitted about the outer periphery of the outer spout; and (h) a retaining element threadably received in the body outlet for axial advancement along the outer periphery of the outer spout for sealing engagement with the vapor seal.

11. A dispensing nozzle comprising:

(a) a nozzle body having an inlet and an outlet with a flow passage therebetween;

(b) a fluid dispensing spout extending from the nozzle body outlet in selective fluid communication with the flow passage;

(c) an outer spout generally concentric to the fluid dispensing spout, said outer spout and said dispensing spout defining an interspoutal passageway being in vapor communication with the exterior of the outerspout and in selective vapor communication with a portion of the nozzle body; and (d) sealing means for selectively blocking vapor communication between the interspoutal passageway and the portion of nozzle body, said sealing means being responsive to fluid flow through the flow passage to permit vapor flow whenever fluid is flowing through the flow passage and to block vapor communication whenever fluid flow through the flow passage is terminated.

12. A dispensing nozzle as recited in claim 11 wherein said sealing means is biased to a normally closed position in which it blocks vapor communication between the interspoutal passageway and the portion of the nozzle body, said sealing means being movable to an open position in response to fluid flow through the flow passage.

13. A dispensing nozzle as recited in claim 11 further including a piston member axially movable within a cylinder in response to fluid flow through the fluid passage, linkage means between said piston member and said sealing means for moving the sealing means in response to movement of said piston member.

14. A dispensing nozzle as recited in claim 13 wherein said linkage means is provited at a location between said piston and said sealing means.

15. A dispensing nozzle as recited in claim 13 wherein said cylinder is in open fluid communication with said flow passage.

16. A dispensing nozzle as recited in claim 13 wherein said linkage means includes a yoke with two extending arm sections, each of said arms being bifurcated.

17. A vapor recovery dispensing nozzle for use in dispensing gasoline, comprising:

(a) a nozzle body having an inlet and an outlet and a liquid flow passage therebetween;

(b) a manually operated valve in the liquid flow passage intermediate of the inlet and outlet for controlling fluid flow through the nozzle;

(c) a fluid dispensing spout extending from the nozzle body in fluid communication with the nozzle body outlet;

(d) an outer spout generally concentric to the fluid dispensing spout, said outer spout and said dispensing spout defining an interspoutal vapor passageway between the spouts, said interspoutal passageway being in vapor communication with the exterior of the outer spout and in selective vapor communication with a portion of the nozzle body; and (e) sealing means for selectively blocking and establishing vapor communication between said interspoutal passageway and said portion of said nozzle body in response to the position of said manually operated valve.

18. A vapor recovery dispensing nozzle as recited in claim 17 further including an actuator responsive to the position of said manually operated valve for controlling the position of said sealing means.

19. A vapor recovery dispensing nozzle as recited in claim 18 further including linkage means between said actuator and the sealing means for converting movement of said actuator into movement of said sealing means.

20. A vapor recovery dispensing nozzle, comprising:

(a) a nozzle body having an inlet and an outlet with a flow passage therebetween;

(b) an adapter securely fitted in the outlet of the nozzle body;

(c) a pair of rigid concentric spouts extending from the nozzle body outlet including an interspout disposed within an outer spout; an end portion of the outer spout being sealingly received by the adaptor for selective fluid communication with the nozzle body inlet;

(d) retaining means releasably secured to the nozzle body for securing both the outer spout and the inner spout relative to the nozzle body, said retaining means having a preferred spot of weakening which facilitates breakage at a preferred location to permit separation of both the inner and outer spouts from the nozzle body whenever the nozzle is subjected to predetermined stresses.

21. A vapor recovery dispensing nozzle as recited in claim 20 further including an anchoring spring disposed about the periphery of said outer spout, a pair of pins extending from said nozzle body, said spring having an end portion wrapped around one of said pins, a push nut fitted about said other pin and engaging said end portion of said anchoring spring.

* * * * *